United States Patent [19]

Rainal

[11] 4,157,612

[45] Jun. 12, 1979

[54] METHOD FOR IMPROVING THE TRANSMISSION PROPERTIES OF A CONNECTORIZED FLAT CABLE INTERCONNECTION ASSEMBLY

[75] Inventor: Attilio J. Rainal, Convent, N.J.

[73] Assignee: Bell Telephone Laboratories, Incorporated, Murray Hill, N.J.

[21] Appl. No.: 864,337

[22] Filed: Dec. 27, 1977

[51] Int. Cl.[2] ..... H01R 11/32

[52] U.S. Cl. ..... 29/628; 174/32; 174/117 F; 339/176 MF

[58] Field of Search ..... 29/628; 339/176 MF, 339/14 R, 17 F; 174/32, 72 A, 117 F, 117 FF; 72/628

[56] References Cited

U.S. PATENT DOCUMENTS

| | | | |
|---|---|---|---|
| 3,399,372 | 8/1968 | Uberbacher | 339/14 R |
| 3,591,834 | 7/1971 | Kolias | 339/176 MP |
| 3,634,806 | 1/1972 | Fergusson | 339/14 R |
| 3,763,306 | 10/1972 | Marshall | 174/117 F |
| 3,864,011 | 2/1975 | Huber | 339/176 MF |
| 3,871,728 | 3/1975 | Goodman | 339/14 R |
| 4,035,050 | 7/1977 | Volinskie | 339/176 MF |
| 4,072,387 | 2/1978 | Sochor | 339/176 MF |
| 4,083,615 | 4/1978 | Volinskie | 339/176 MF |

*Primary Examiner*—C. W. Lanham
*Assistant Examiner*—Gene P. Crosby
*Attorney, Agent, or Firm*—John W. Fisher

[57] ABSTRACT

A method is disclosed for improving the transmission properties of balanced and unbalanced connectorized flat cable interconnection assemblies. In accordance with the method, a first set of generally parallel flat cable conductors are terminated on a first mapped set of connector contacts such that all conductors are connectable to a source of ground potential. A second set of generally parallel flat cable conductors are terminated on a second mapped set of connector contacts such that the odd-numbered conductors are connectable to a source of ground potential and the even-numbered conductors are connectable to a plurality of signal sources. The termination of flat cable conductors in accordance with this method also results in an improvement in the packaging density of pluggably interconnectable circuits.

16 Claims, 10 Drawing Figures

G S G S G S G S·····
G G G G G G G G·····

G G S G G S G G S G G G·····
G G G G G G G G G G G G·····

G G G S G G G S G G G G·····
G G G G G G G G G G G G·····

G S G G S G G G S G S·····NONADJACENT SIGNALS
G G G G G G G G G G G G·····ALL GROUNDS

G S S G S S G S S·····
G G G G G G G G G·····

G G S S G G S S G G S S·····NONADJACENT PAIRS OF SIGNALS
G G G G G G G G G G G G·····ALL GROUNDS

METHOD FOR IMPROVING THE TRANSMISSION PROPERTIES OF A CONNECTORIZED FLAT CABLE INTERCONNECTION ASSEMBLY

BACKGROUND OF THE INVENTION

1. Field of the Invention

This application relates to electrical connections and, more particularly, to a method for effecting electrical connections such that an improvement in the transmission properties of a connectorized flat cable interconnection assembly is achieved.

2. Description of the Prior Art

Oftentimes coaxial cables are used to effect the interconnection of many high-speed or broadband circuits. Such cables are expensive, bulky and difficult to terminate on multilayer backplanes comprised of a field of interconnection pins. Attempts to reduce the amount of space needed has led to the use of flat cable interconnection assemblies.

One illustration of the extent to which flat calbes have been employed for interconnection purposes is contained in an article entitled "Interconnection Systems—Mass Termination Schemes Make Flat Cable Economically Viable," appearing in *EDN* magazine, Sept. 20, 1975, at pages 22 through 29. While the use of flat cable results in certain economies of space, oftentimes the transmission characteristics are less than optimal.

In an attempt to improve the transmission characteristics, various signal patterns have been proposed for application to flat cable. For example, in J. T. Kolias, U.S. Pat. No. 3,591,834, issued July 6, 1971, a signal arrangement comprised of alternating signal leads and ground leads is disclosed. While this signal distribution results in some improvement, many of the transmission characteristics, such as bandwidth, cross-talk, impedance match, and the like, are not so significantly improved as to make flat cable interconnection a viable alternative to coaxial cable.

Some improvement in the impedance matching characteristics of connectors was effected by I. L. Fergusson and is disclosed in his U.S. Pat. No. 3,634,806, issued Jan. 11, 1972. Fergusson relates to a match impedance connector which prevents an impedance interruption when multiconductor flat cable is connected to a printed circuit board. The connector block has two staggered rows of molded cavities into which are inserted a plurality of connector pins. The connector pins are electrically connected to alternate signal and ground conductors of a multiconductor flat cable. A metallic plate is disposed between the two rows of connector pins and is connected to the ground pins. While Fergusson's connector represents a step in the right direction, little attention is given to effecting improvements in the transmission characteristics of the media interconnecting such connectors.

Accordingly, it is one object of the present invention to improve the transmission properties of a connectorized flat cable interconnection assembly.

It is another object to decrease the amount of crosstalk between adjacent assemblies.

A further object of the present invention is to control the impedance matching characteristics throughout the length of the interconnection assembly.

Still another object is to improve the usable transmission bandwidth of a flat cable interconnection assembly.

Yet a further object of the present invention is to reduce the cost of a flat cable interconnection assembly.

An even further object is to increase the packaging density achievable through the use of flat cable interconnection assemblies.

SUMMARY OF THE INVENTION

The foregoing and other objects of the invention are realized in an illustrative embodiment of a method for improving the transmission properties of a balanced or unbalanced connectorized flat cable interconnection assembly. In accordance with the method, a first set of generally parallel conductors are terminated on a first mapped set of connector contacts such that a predetermined number of conductors are connectable to a source of ground potential. A second set of generally parallel conductors are terminated on a second mapped set of connector contacts such that specified ones of the conductors are connectable to a plurality of signal sources and the remainder of the conductors are connectable to the source of ground potential.

Accordingly, it is one feature of the present invention that connectorized flat cable assemblies terminated in accordance with the subject method exhibit reduced crosstalk when such cable assemblies are stacked atop one another.

Another feature is that flat cable assemblies utilizing the subject signal distribution scheme are susceptible to mass termination techniques.

A further feature of the present invention is that connectorized flat cable assemblies terminated in accordance with applicant's method exhibit reduced susceptibility to and the generation of electromagnetic interference.

Still another feature is that connectorized flat cable assemblies terminated in accordance with applicant's method exhibit controlled impedance characteristics throughout their length.

Yet a further feature of the present invention is that flat cable interconnection assemblies improve the packaging density of digital interconnection wiring.

Still a further feature is that both balanced and unbalanced circuits may be advantageously interconnected.

An even further feature is that the overall cost of interconnection wiring is advantageously reduced.

BRIEF DESCRIPTION OF THE DRAWINGS

The aforementioned objects and features of the invention, as well as other objects and features, will be better understood upon a consideration of the following detailed description and the appended claims, taken in conjunction with the attached drawings of an illustrative embodiment in which:

DETAILED DESCRIPTION

Figure 1A:
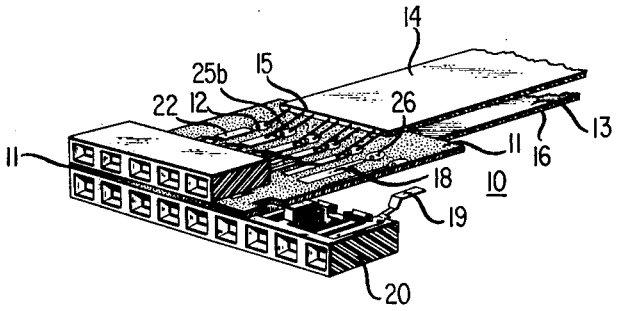
FIGS. 1A and 1B illustrate a flat cable interconnection assembly including a connectorized printed wiring board with plated-through holes for effecting cable conductor mapping.
Figure 1B:
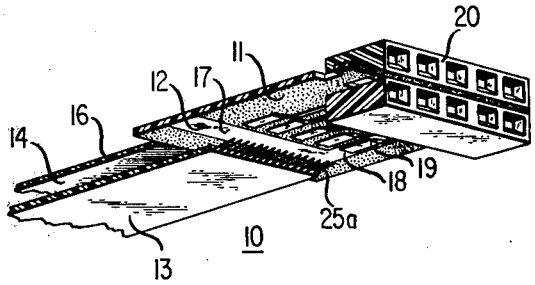

A connectorized flat cable interconnection assembly 10, as shown in FIGS. 1A and 1B, includes a printed wiring board 11 having a plurality of plated-through holes 12 therein. Flat cables 13 and 14, having a plurality of generally parallel conductors 15 therein, are terminated on the printed wiring board 11. Typically, cables 13 and 14 have either 24 or 31 28-to-32 gauge conductors therein, but other numbers and sizes of conductors are suitable.

Although two flat cables 13 and 14 are illustrated, other arrangements may be readily employed. For example, a single flat cable (not shown) having two planar arrays of individual conductors 15 spaced apart by approximately 0.03125 inch and embedded in a common dielectric material 16 might be utilized.

One array or set of generally parallel conductors 25*a* in cable 13 is terminated on printed wiring board 11 through solder attachment or the like to a common bus 17 on board 11. Common bus 17 is connected to a source of ground potential (not shown). By virtue of mapping effected through conductive patterns 18 and plated-through holes 12, this ground connection is coupled to one or more ground contacts 19 in connector 20.

Another array or set of generally parallel conductors 25*b* in cable 14 is terminated in alternating sequence on a common bus (not shown) similar to common bus 17. Interleaving conductors 26 are coupled to one or more signal sources (not shown). Again, by virtue of mapping effected through conductive patterns 18 and plated-through holes 12, interleaving conductors 26 are coupled to various signal contacts 22 appearing on connector 20. The remainder of conductors 26 are connected to the source of ground potential (not shown).

Figures 2A, 2B, 2C, 2D, 2E, 3A, 3B:
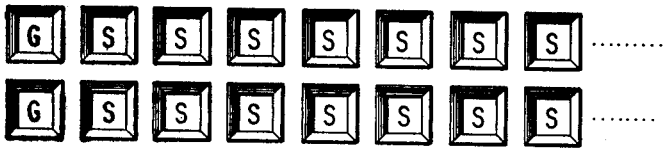
FIGS. 2A through 2D illustrate various signal patterns before mapping for unbalanced circuits used in practicing applicant's terminating method.
FIG. 2E illustrates the signal distribution in the connector after mapping.
FIGS. 3A and 3B illustrate various signal patterns before mapping for balanced circuits used in practicing applicant's terminating method.

As illustrated in FIG. 2A, a preferred embodiment for an unbalanced circuit flat cable conductor termination before mapping utilizes a common ground connection for all conductors in one cable. These connections are illustrated by the Gs in FIGS. 2 and 3. Individual conductors in the other cable have, for example, all odd-numbered conductors connected to ground and all even-numbered conductors connected to one or more signal sources (not shown). The signal source terminations are represented by the Ss in FIGS. 2 and 3.

In another arrangement, illustrated in FIG. 2B, again one array of conductors is terminated to ground. However, in this arrangement pairs of grounded conductors in the other array appear between the signal carrying conductors.

A third arrangement is shown in FIG. 2C. In this arrangement three grounded conductors are interposed between adjacent signal carrying conductors.

In general, as shown in FIG. 2D, any desired number of grounded conductors can be interposed advantageously between adjacent signal carrying conductors. When the conductors in one array are held at ground potential and the signal conductors are separated by at least one grounded conductor, improvements in the transmission characteristics, such as bandwidth, crosstalk, impedance match, and the like, can be effected advantageously.

FIG. 2E illustrates the signal distribution in connector 20 after mapping.

The termination arrangements shown in FIGS. 3A and 3B are employed for balanced circuits. These arrangements are very similar to the unbalanced cases shown in FIGS. 2A and 2B, except pairs of signal leads are used.

It should be noted than one or more ground connections can be advantageously left floating on one or both ends to further improve the transmission properties. In addition, the improved transmission properties enhance the propagation characteristics of both digital and analog signals, the latter especially in balanced circuit cases.

Figure 4:
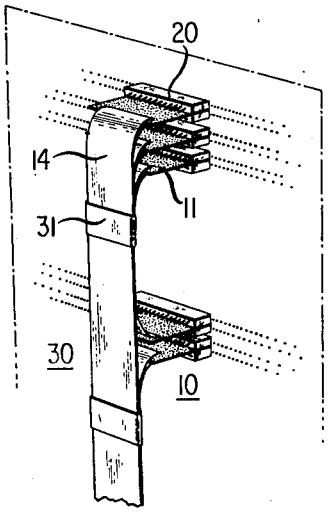
FIG. 4 illustrates the improved interconnection wiring density obtainable with a flat cable interconnection harness.

As shown in FIG. 4, the interconnection wiring density can be greatly enhanced when stacks of connectorized flat cable assemblies 10, terminated as noted above, are utilized. A wiring harness 30 is fabricated by forming a connectorized flat cable interconnection assembly 10. After forming, assemblies 10 are stacked one atop another and lashed together by bands 31.

In such stacked arrangements, each signal carrying conductor is effectively surrounded by a plurality of grounded conductors. The result of this arrangement is that each signal carrying conductor takes on the appearance of a coaxial cable center conductor and the surrounding grounded conductors take on the appearance of a coaxial cable ground sheath. For the balanced configuration, pairs of signals appear as a balanced pair with a coaxial ground.

In all cases it is to be understood that the above-described embodiments are illustrative of but a small number of many possible specific embodiments which can represent applications of the principles of the invention. Thus, numerous and various other embodiments can be devised readily in accordance with these principles by those skilled in the art without departing from the spirit and scope of the invention.

What is claimed is:

1. A method for improving the transmission properties of an unbalanced connectorized flat cable interconnection assembly including the steps of:

terminating a first set of generally parallel conductors on a first mapped set of connector contacts such that all conductors are connectable to a source of ground potential; and terminating a second set of generally parallel conductors on a second mapped set of connector contacts such that specified ones of said conductors are connectable to a plurality of signal sources and the remainder of said conductors are connectable to said source of ground potential.

2. The method in accordance with claim 1 wherein said specified ones of said conductors of said second set which are connectable to said plurality of signal sources comprises all even-numbered conductors in said second set.

3. The method in accordance with claim 1 wherein said specified ones of said conductors of said second set which are connectable to said plurality of signal sources comprises every third conductor.

4. The method in accordance with claim 1 wherein said specified ones of said conductors of said second set which are connectable to said plurality of signal sources comprises every fourth conductor.

5. The method in accordance with claim 1 wherein said specified ones of said conductors of said second set which are connectable to said plurality of signal sources comprises any nonadjacent ones of said conductors.

6. A method for improving the transmission properties of a balanced connectorized flat cable interconnection assembly including the steps of:

terminating a first set of generally parallel conductors on a first mapped set of connector contacts such that all conductors are connectable to a source of ground potential; and terminating a second set of generally parallel conductors on a second mapped set of connector contacts such that specified pairs of said conductors are connectable to a plurality of signal sources and the remainder of said conductors are connectable to said source of ground potential.

7. The method in accordance with claim 6 wherein said specified pairs of said conductors of said second set which are connectable to said plurality of signal sources are separated from one another by at least one conductor connected to said source of ground potential.

8. A method for improving the transmission properties of an unbalanced connectorized flat cable interconnection assembly including the steps of:

terminating a first set of generally parallel flat cable conductors on a first mapped set of connector contacts such that all conductors are connectable to a source of ground potential; and terminating a second set of generally parallel flat cable conductors on a second mapped set of connector contacts such that the odd-numbered conductors are connectable to said source of ground potential and the even-numbered conductors are connectable to the plurality of signal sources.

9. The method in accordance with claim 8 wherein at least one of said conductors connectable to said signal sources is connectable to said source of ground potential.

10. A method for improving the transmission properties of an unbalanced connectorized flat cable interconnection assembly including the steps of:

terminating a first set of generally parallel flat cable conductors on a first mapped set of connector contacts such that all conductors are connectable to a source of ground potential; and terminating a second set of generally parallel flat cable conductors on a second mapped set of connector contacts such that two conductors connectable to said source of ground potential separate each conductor connectable to a signal source.

11. A method for improving the transmission properties of an unbalanced connectorized flat cable interconnection assembly including the steps of:

terminating a first set of generally parallel flat cable conductors on a first mapped set of connector contacts such that all conductors are connectable to a source of ground potential; and terminating a second set of generally parallel flat cable conductors on a second mapped set of connector contacts such that three conductors connectable to said source of ground potential separate each conductor connectable to a signal source.

12. A method for improving the interconnection cabling density of pluggably interconnectable electrical circuits including the steps of:

terminating a first set of generally parallel conductors on a first mapped set of connector contacts such that all conductors are connectable to a source of ground potential;

terminating a second set of generally parallel conductors on a second mapped set of connector contacts such that specified ones of said conductors are connectable to a plurality of signal sources and the remainder of said conductors are connectable to said source of ground potential;

forming a connectorized flat cable interconnection assembly;

stacking connectorized flat cable assemblies one atop another; and lashing said connectorized flat cable assemblies together to form a flat cable interconnection wiring harness.

13. The method in accordance with claim 12 wherein said specified ones of said conductors of said second set which are connectable to said plurality of signal sources comprises all even-numbered conductors in said second set.

14. The method in accordance with claim 12 wherein said specified ones of said conductors of said second set which are connectable to said plurality of signal sources comprises every third conductor.

15. The method in accordance with claim 12 wherein said specified ones of said conductors of said second set which are connectable to said plurality of signal sources comprises every fourth conductor.

16. The method in accordance with claim 12 wherein said specified ones of said conductors of said second set which are connectable to said plurality of signal sources comprises any nonadjacent ones of said conductors.

* * * * *